United States Patent [19]

Spitzke

[11] 4,098,478

[45] Jul. 4, 1978

[54] PORTABLE FOLDING SEAT

[75] Inventor: Arthur Spitzke, Troy, Mich.

[73] Assignee: Matrix Corporation, Troy, Mich.

[21] Appl. No.: 783,866

[22] Filed: Apr. 1, 1977

[51] Int. Cl.[2] ..... A47C 9/10

[52] U.S. Cl. ..... 248/156; 108/115; 108/150; 297/4

[58] Field of Search ..... 248/156, 155, 155.1, 248/155.3; 108/150, 115; 297/4, 183

[56] References Cited

U.S. PATENT DOCUMENTS

| | | | |
|---|---|---|---|
| Re. 26,779 | 2/1970 | Weicheurieder | 248/156 X |
| 444,621 | 1/1891 | Schneider | 248/155.1 |
| 2,800,164 | 7/1957 | Chambers | 248/156 X |
| 3,327,656 | 6/1967 | Schwartz | 108/150 |
| 3,467,033 | 9/1969 | Sienkiewicz | 248/156 X |
| 3,895,839 | 7/1975 | Amato | 297/4 |

FOREIGN PATENT DOCUMENTS

| | | | |
|---|---|---|---|
| 850,535 | 9/1939 | France | 248/156 |

*Primary Examiner*—Francis K. Zugel
*Attorney, Agent, or Firm*—Fisher, Gerhardt & Groh

[57] ABSTRACT

A portable seat may be folded to a transport position by disposing the seat and support member in generally parallel relationship to each other and in a plurality of select positions longitudinally of each other, the entire seat assembly being suitable to transport by hanging from the belt or the like of a wearer. The seat is provided with a removable prong which pierces the ground to support the seat assembly when it is not occupied and also may be removed for the purpose of utilizing the seat on hard surfaces such as those encountered indoors.

17 Claims, 11 Drawing Figures

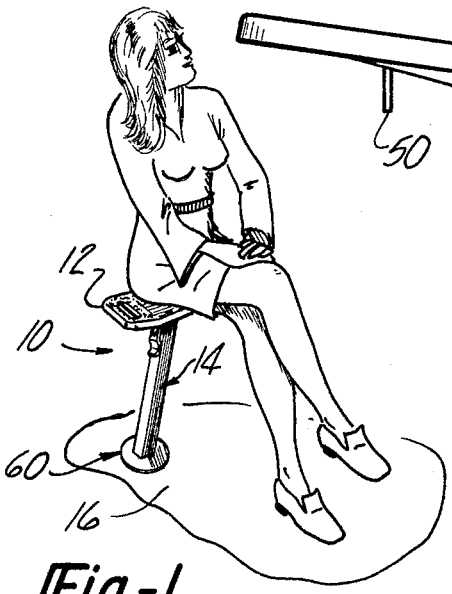
Fig-1
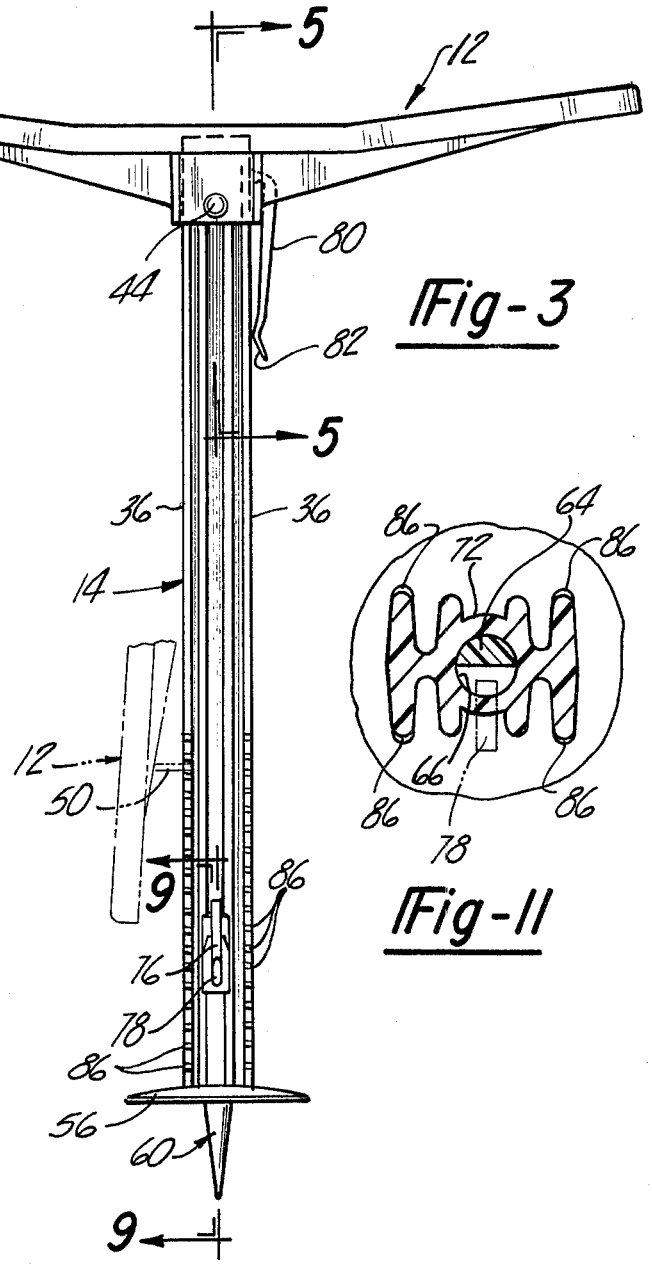
Fig-3
Fig-11
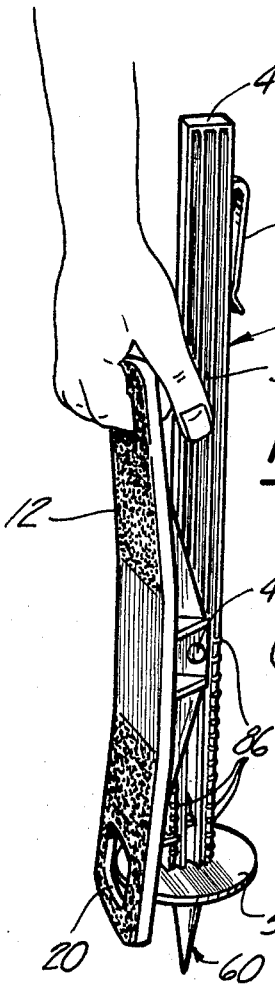
Fig-2
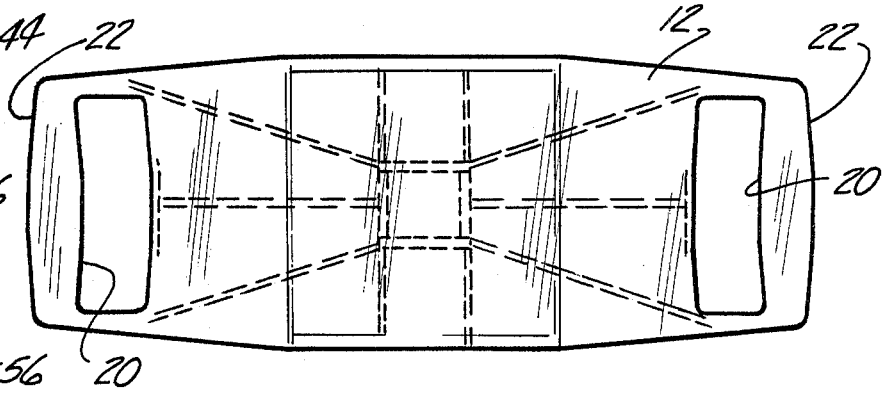
Fig-4

PORTABLE FOLDING SEAT

This invention relates to portable seats and more particularly to portable folding seats of the type used by sportsmen and spectators at sporting and other events.

Various forms of portable seats have been provided but for the most part they are costly because of the manufacturing process which normally includes machining of many metal parts and also the seats are heavy in order to impart the necessary strength which at the same time detracts from the portability of such seats. Some seats are collapsible to a transport position and others incorporate separable parts which are easily lost or misplaced and make the seat inoperative.

It is an object of the invention to provide a portable seat which may be easily folded to a collapsed transport position.

Another object of the invention is to provide a portable seat which is light in weight and at the same time strong and durable.

Still another object of the invention is to provide a portable seat in which all of the parts are made of the same material, preferable a plastic.

Another object of the invention is to provide a portable seat which may be used both on bare ground or lawn or on hard surfaces.

Still another object of the invention is to provide a portable seat which may be folded to a compact collapsed position and in which the seat can be positioned selectively longitudinally of a support member to properly balance the collapsed seat for transport.

Yet another object of the invention is to provide a portable seat which in its collapsed position may be conveniently carried by hand or suspended from the belt or the like of the user.

The portable seat embodying the invention includes a seat member that may be folded to a generally parallel position relative to a support member and can slide to selected positions longitudinally of the support member for purposes of transporting the folded seat member. The seat member incorporates a hanger on the support member which serves to suspend the collapsed seat assembly from the belt or pocket of the wearer. The lower end of the support member is provided with a stop element which resists penetration into soft ground and also cooperates with openings in the seat when the seat is in its folded condition to limit relative sliding movement of the seat relative to the support member. The hole at one edge of the seat and like hole at the other edge of the seat form handholds which help to position the seat relative to the posterior of a user. In the folded position the seat engages selected portions of the support member disposed longitudinally thereof so that the seat may be balanced relative to the support member to suit the preference of the user carrying the seat. The selected positions are determined by a plurality of spaced stop elements which cooperate with the latch mechanism to limit movement. The lower end of the support member is provided with a detachable prong such that on lawns and ground surfaces the prong pierces the earth and serves to support the seat in the event that the user chooses to rise and then reseat himself. The prong itself may be detached from the remainder assembly so that the seat may be used on hard surfaces such as pavement or indoor floor surfaces. All of the elements of the seat assembly remain attached to each other when the seat is collapsed for transport and all of the parts are made of the same material such as a thermoplastic material, for example.

FIG. 1 is a perspective view of the portable seat embodying the invention as it would appear in use;

FIG. 2 is a perspective view of the portable seat seen in FIG. 1 in its collapsed, transport condition;

FIG. 3 is an elevation of the portable seat embodying the invention shown in its unfolded or seating position;

FIG. 4 is a top view of the seat seen in FIG. 3;

FIG. 11 is a cross-sectional view taken on line 11—11 in FIG. 9.

Figure 5:
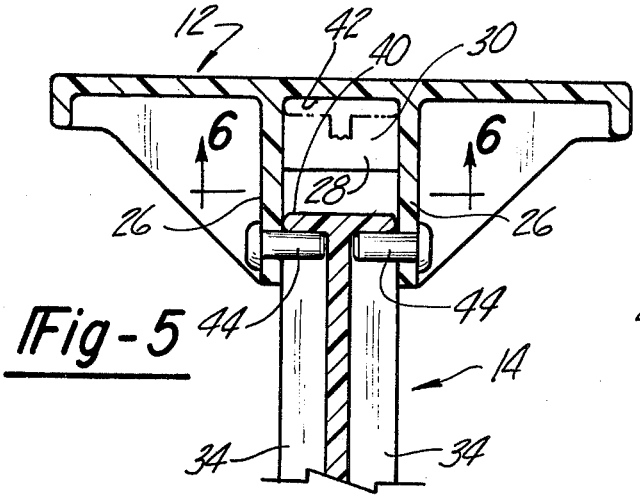
FIG. 5 is a cross-sectional view taken on line 5—5 in FIG. 3.

Referring to the drawings the portable seat embodying the invention is designated generally at 10 and includes the seat portion or member 12 and a support member 14 which as shown in FIG. 1 acts to support the seat member in an elevated position above a base surface such as the ground 16. In general the seat assembly is intended to be in the position shown in FIGS. 1 and 3 when in use and to be collapsed or folded to the position illustrated in FIG. 2 for transport.

The seat portion or seat member 12 as seen in FIG. 3 and 4 has a gently curved upper surface 18 and a pair of recesses 20 which are disposed adjacent the side edges 22 of the seat member and form handholds by which a user of the seat may position the seat relative to his posterior while locating the support member relative to the ground or floor.

The seat member 12 is supported in an elevated position by the support member 14. When the seat is in the seating position seen the FIG. 3, the upper end of the support member 14 is seated in a socket means 24 which is best seen in FIG. 5 and 6.

The socket means 24 includes a pair of opposed walls 26 and another pair of opposed walls 28 which form a generally rectangular recess or socket 30 to receive the upper end of the support member 14. As seen in FIG. 6 the cross-section of the support member 14 is such that it forms an overall rectangular configuration conforming to the recess 30 with a central web 31 from which pairs of longitudinally extending inner ribs 32 project to form oppositely facing guide groves 34. Also, the support member includes outer flange members 36 at the ends of web 31 which form groves 38. The flanges 36 and ribs 32 serve to form a rigid construction and at the same time affords a relatively light support member 14.

Figure 6:
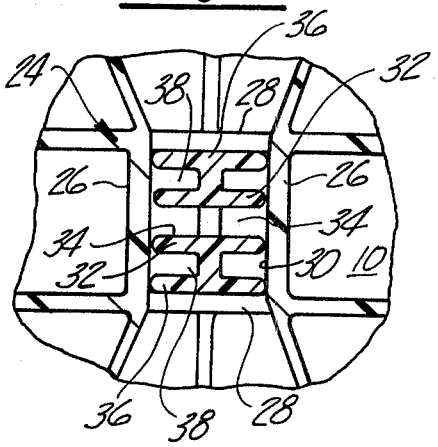
FIG. 6 is a sectional view with parts broken away, taken generally on line 6—6 in FIG. 5.

When the upper end of the support member 12 is properly positioned in the socket means 24 to support the seat member 12 in seating position an end wall 40 at the extreme upper end of the support member 14 is engaged with the bottom wall 42 of the recess 30 as shown in broken line in FIG. 5.

As best seen in FIG. 5, the walls 26 depend below the walls 28 and support, respectively, a pair of pivot pins 44. The pins 44 are axially aligned with each other and project into the guide groves 34 at the opposite sides of the central web 31.

The guide groves 34 permit pivotal movement of the support member 14 relative to the seat member 12 so that the seat and support members 12 and 14 may be aligned with each other after which the support member 14 may be pushed into the socket means 24 from the full line position seen in FIG. 5 to the broken line position. In the latter position, which also is the position illustrated in FIG. 3, the spaced apart socket means 24 and the pins 44 cooperating and engaging the ribs 32 prevent the seat member 12 from pivoting relative to the support member 14.

Figure 7:
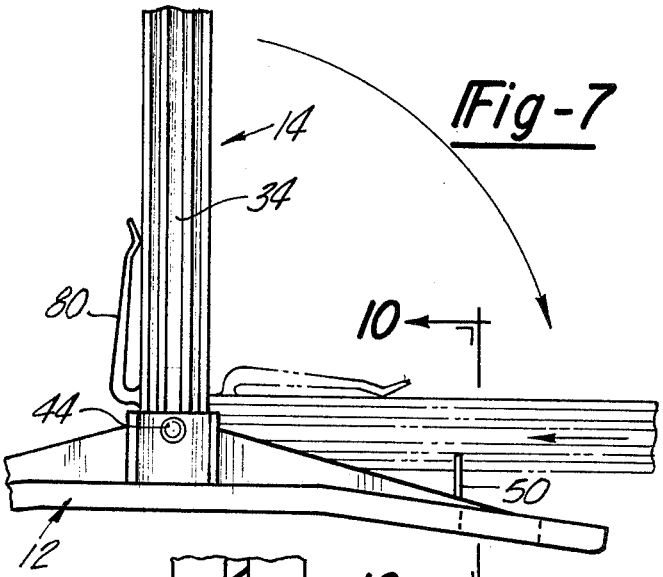
FIG. 7 is a view of the seat seen in FIG. 3 showing two positions of movement of the support member relative to the seat member.
Figure 10:
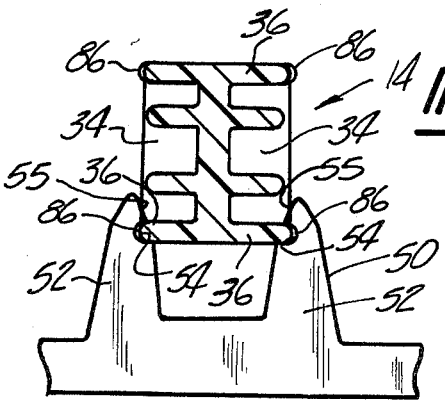
FIG. 10 is a cross-sectional view of the latch mechanism taken generally on line 10—10 in FIG. 7.

The pins 44 permit pivotal movement of the support member 14 relative to the seat member 12 after the support member 14 has been withdrawn from the socket means 24 as shown in the full line position in FIG. 5 and FIG. 7. Thereafter the support member 14 may be pivoted to a position in which it lies generally parallel to the seat member 12 as seen in broken line in FIG. 7. In this latter position support member 14 may slide relative to the seat member 12, such movement being permitted by the pins 44 which slide in the guide groves 34. In the parallel folded position, the support member 14 engages a latch 50. As seen in FIG. 10, the latch 50 includes a pair of catch elements 52 which are formed with facing groves 54 which are adapted to engage one of the outer flanges 36. The catch elements 52 which are formed with cam surfaces 55 are molded integrally with the seat member 12 and deflect sufficiently relative to the main portion of the seat so that engagement of a flange 36 with cam surfaces 55 temporarly spaces the elements 52 and permits flange 36 to move into groves 54. This retains the support member 14 in generally parallel position relative to the seat member 12.

Figure 8:
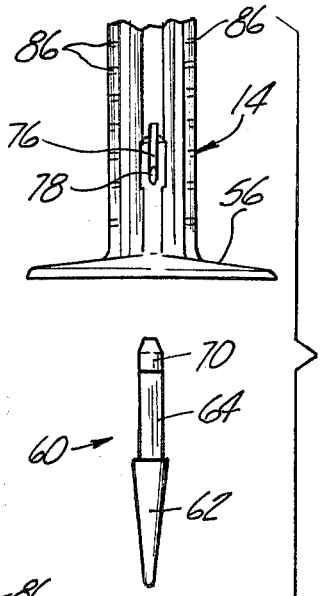
FIG. 8 is a view similar to FIG. 3 showing the lower portion of the seat assembly with portions broken away and with the prong member removed from the assembly.

The lower end of the support member 14 is provided with a disc shaped plate or base element 56 and a depending prong 60. The base element 56 affords a bearing surface for resting on the surface which supports the seat assembly 10 and on soft surfaces such as lawns prevents the seat from penetrating into the ground under load. The base element has a generally concave surface as seen in FIG. 9 and in the condition in FIG. 8 with the prong 60 removed, offers a large bearing surface to rest on hard surfaces such as pavement or floors.

The prong member 60 which depends below the base member 56 acts to pierce the soil when the seat is used out-of-doors and acts to support the seat in a vertical position in the event that the user rises from the seat. The prong number 60 is removable to make the seat assembly adaptable for use on hard surfaces.

Figure 9:
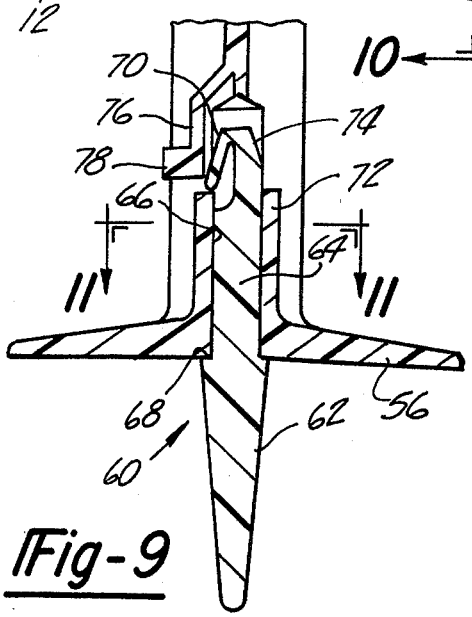
FIG. 9 is an enlarged view of the lower portion of the assembly similar to FIG. 8 but with the prong in position.

As seen in FIG. 9, the prong member 60 has a point portion 62 and a barrel portion 64 adapted to be seated in a bore 66 formed at the lower end of the support member 14. A shoulder 68 between the point portion 62 and the barrel 64 limits upward movement of the prong member 60 relative to the support member 14. The upper end of the barrel 64 is provided with a detent 70 which in the normal, as-molded condition of the prong member 60 engages the upper surface of the collar 72 in which bore 66 is formed. During insertion of the prong member 60 into the bore 66 tapered surface 74 assists alingment and upon movement of the prong member upwardly as viewed in FIG. 9, the detent 70 will deflect to permit insertion of the prong member 60 until the detent reaches a position above collar 72 at which the detent springs back to its as-molded condition which as seen in FIG. 9, prevents withdrawal of the prong member 60.

A release latch is molded integrally with member 14 in guide groves 34. The release forms an elongated finger which is flexible relative to the central web 31 and has a button portion 78 near the outer opening of groves 34. When it is desired to withdraw the prong member 60, the button 78 and therefore release latch 76 may be depressed with the finger until the detent 70 is engaged and deflected radially inwardly a sufficient amount so that the prong member 60 may be withdrawn from the bore 66.

The upper end of the support member 14 is provided with a hanger member 80 which is molded integrally with the support member 14 and permits limited deflection. The hanger member has a cam surface 82 which serves to guide and deflect the hanger 80 over a belt or the like of a person using the seat so that in the collapsed or transport position of the seat assembly it may be easily carried leaving the hands free for other purposes.

The portable seat assembly 10 is shown in its unfolded, seating condition in FIGS. 1 and 3. To place the seat assembly in its folded or transport condition as seen in FIG. 2 the support member 14 is withdrawn from the socket means 24 from the broken line position seen in FIG. 5 to the full line position. Such withdrawal of the support member 14 is afforded by sliding movement of the pins 44 in the guide groves 34. Thereafter, as seen in FIG. 7, the support member 14 may be pivoted so that it lies generally parallel to the seat member 12. In this condition the seat member 12 can be moved longitudinally relative to the support member 14 during which time the pins 44 slide in the guide groves 34. Such sliding movement can continue until the seat member is positioned with the pivot pins 44 at some point intermediate to the ends of the support member 14. As seen in FIG. 2 the seat and support member 12 and 14 may be moved relative to each other until a peripheral edge of the base plate 56 is aligned with one of the recesses 20 forming the handholds. Thereafter the support member 14 may be pressed into engagement with the latch mechanism 50 to retain the seat member and support member parallel to each other. The base 56 in the recess 20 forms a stop member which interferes with the seat to limit relative movement between the two members.

If desired, the seat member 12 may be maintained in various positions longitudinally of the support member 14 other than the one position shown in FIG. 2. For example, as illustrated in the broken lines in FIG. 3, the latch 50 may be bought into engagement with the outer flange 36. For this purpose the outer flanges 36 at the lower end of the support member 14 are provided with a plurality of uniformly spaced ridges or stops 86 which also can be seen in FIGS. 8 and 10. The catch element 52 of the latch mechanism 50 may be disposed between selected adjacent pairs of the ridges 86 so that the seat member 12 may be positioned in a selected position longitudinally of the support member 14. This feature permits adjustment to change the balance to suit the comfort of the user who may be transporting the seat assembly 10 by hanging it from his clothing with the hanger 80.

The entire portable seat assembly which is made up of the seat member 12, the support member 14, the pair of pins 44 and the prong member 16 are all made of the same plastic material which may be a acrylonitrile butadyne styrene or a high detensity polyethylene or the like. These five parts are molded separately and at the end of the manufacturing process are assembled by inserting the prong 60 in the lower end of the support member 14. Assembly is completed by positioning the support member 14 relative to the seat 12 so that the pins 44 may be pressed into openings in the walls 26 of the socket means so the inner ends of the pins are disposed in the groves 34.

A portable seat has been provided in which all of the components can be made of the same plastic material and in which a seat portion may be folded relative to a support portion and can be moved to selected positions longitudinally of the support and parallel thereto for the purpose of transporting the folded seat member. In the folded condition, all of the components remain attached to each other and the assembly incorporates a hanger which can be used to suspend the collapsed seat from a belt or the like of a person or from a golf bag, for example. The lower end of the support member is provided with a stop member which prevents undue penetration into soft ground and also with a prong member which serves to pierce the ground and maintain the seat in the vertical position when it is not occupied. The prong may be removed for use of the seat assembly on hard surfaces such as those encountered indoors.

The embodiments of the invention in which an exclusive property or privilege is claimed are defined as follows:

1. A portable seat comprising; a seat member, support member for supporting said seat member in an elevated position above the ground, a socket means formed at the underside of said seat member for receiving the upper end of said support member to hold said members in a fixed relative position for use, pivot means associated with said seat member, guide means associated with said support member and receiving said pivot means to permit sliding movement of said pivot means relative to said support during displacement of said support from said socket means to a folding position, said support member being pivotal relative to said seat member from said folding position to a folded position wherein said support member and seat member are disposed generally parallel to each other, said seat member being slidable from said folded position longitudinally of said support member to selected storage positions with said pivot means movable to positions between the opposite ends of said support member, latch means associated with said seat member and support member to limit said sliding movement of said seat and support members relative to each other and maintain said members in said selected storage positions.

2. The combination of claim 1 in which said seat member, support member, socket means, pivot means, guide means, and means limiting sliding movement are all made of plastic material.

3. The combination of claim 1 in which said seat member is formed with openings forming handholds at opposite sides of said seat.

4. A portable seat comprising; a seat member, a support member for supporting said seat member in an elevated position above the ground, a socket means formed at the underside of said seat member for receiving the upper end of said support member to hold said members in a relative position for use, pivot means associated with said seat member, guide means associated with said support member and receiving said pivot means to permit sliding movement relative thereto during displacement of said support from said socket means to a folding position, said support member being pivotal relative to said seat member from said folding position to a folded position wherein said support member and seat member are disposed generally parallel to each other, said seat member being slidable from said folded position longitudinally of said support member to a selected storage position, means associated with said seat member and support member to limit sliding movement of said seat and support members relative to each other and maintain said members in said storage position, said seat member being formed with openings forming handholds at opposite sides of said seat, and wherein said means limiting sliding movement includes a stop member on said support member, said stop member being disposed in a selected one of said handholds.

5. The combination of claim 5 in which said stop member is a plate member extending transversely adjacent one end of said support member.

6. The combination of claim 1 wherein said support member has a plate member extending transversely of and adjacent one end of said support member, said plate member having a concave ground engaging portion.

7. A portable seat comprising; a seat member, a support member for supporting said seat member in an elevated position above the ground, a socket means formed at the underside of said seat member for receiving the upper end of said support member to hold said members in a relative position for use, pivot means associated with said seat member, guide means associated with said support member and receiving said pivot means to permit sliding movement relative thereto during displacement of said support from said socket means to a folding position, said support member being pivotal relative to said seat member from said folding position to a folded position wherein said support member and seat member are disposed generally parallel to each other, said seat member being slidable from said folded position longitudinally of said support member to a selected storage position, means associated with said seat member and support member to limit sliding movement of said seat and support members relative to each other and maintain said members in said storage position, said support member having a plate member extending transversely of and adjacent one end of said support member, said plate member having a concave ground engaging portion, and wherein said seat member is formed with an opening adjacent one side and said plate member is disposable in said opening to form said means limiting sliding movement of said seat and support members.

8. The combination of claim 1 wherein said means limiting movement includes a latch on said seat member detachable engagable with selected portions extending longitudinally of said support member to maintain the latter and the seat member parallel to each other.

9. A portable seat comprising; a seat member, a support member for supporting said seat member in an elevated position above the ground, a socket means formed at the underside of said seat member for receiving the upper end of said support member to hold said members in a relative position for use, pivot means associated with said seat member, guide means associated with said support member and receiving said pivot means to permit sliding movement relative thereto during displacement of said support from said socet means to a folding position, said support member being pivotal relative to said seat member from said folding position to a folded position wherein said support member and seat member are disposed generally parallel to each other, said seat member being slidable from said folded position longitudinally of said support member to a selected storage position, means associated with said seat member and support member to limit sliding movement of said seat and support members relative to each other and maintain said members in said storage position, said means limiting movement including a latch on said seat member detachably engagable with selected portions of said support member extending longitudinally to maintain the latter and said seat member parallel to each other, and wherein said support member is formed with a plurality of uniformly spaced stops extending longitudinally of said support member, adjacent pairs of said stops forming said selected portions.

10. The combination of claim 1 in which said support member mounts a prong at an end opposite to said socket receiving portion for piercing the ground.

11. The combination of claim 10 in which said prong is detachable supported at one end of said support member for removable when said seat is used on a hard surface.

12. The combination of claim 11 in which said prong includes a detent normally biased to a latching position.

13. The combination of claim 12 in which said prong and detent are made of a single piece and of the same material as said seat and support members.

14. The combination of claim 1 in which said support member is elongated and said guide means extend substantially the full length of said support member.

15. The combinations of claim 1 and further comprising bracket means on said support member adjacent to said socket receiving portion of said support member, said bracket means being adapted to receive a belt or the lie to support said seat from a user for transport purposes.

16. The combination of claim 1 wherein said latch means comprises a latch attached to said seat and spaced from said pivot means and in which said support means is movable to a latch engaging position by pivotal movement relative to said seat member.

17. A portable seat comprising; a seat member, a support member for supporting said seat member in an elevated position above the ground, a socket means formed at the underside of said seat memer for receiving the upper end of said support member to hold said members in a reltive position for use, pivot means associated with said seat member, guide means associated with said support member and receiving said pivot means to permit sliding movement relative thereto during displacement of said support from said socket means to a folding position, said support member being pivotal relative to said seat member from said folding position to a folded position wherein said support member and seat member are disposed generally parallel to each other, said seat member being slidable from said folded position longitudinally of said support member to a selected storage position, means associated with said seat member and support member to limit sliding movement of said seat and support members relative to each other and maintain said members in said storage position, said support member mounting a prong at an end opposite to said socket receiving portion for piercing the ground, said prong being detachably supported at one end of said support member for removal when said seat is used on a hard surface, said prong includes a detent normally biased to a latching position, and release means formed integrally with said support member and engagable with said detent for deflecting the latter from said latching position to an unlatching position.

* * * * *

UNITED STATES PATENT AND TRADEMARK OFFICE

CERTIFICATE OF CORRECTION

PATENT NO. : 4,098,478

DATED : July 4, 1978

INVENTOR(S) : Arthur Spitzke

It is certified that error appears in the above-identified patent and that said Letters Patent are hereby corrected as shown below:

Column 6, claim 5, line 1, "5" should read --4--
claim 9, line 66, "socet" should read --socket--
Column 8, claim 15, line 1, "lie" should read --like--
claim 17, line 11, "memer" should read --member--
line 13, "reltive" should read --relative--

Signed and Sealed this

*Third* Day of *April 1979*

[SEAL]

*Attest:*

RUTH C. MASON
*Attesting Officer*

DONALD W. BANNER
*Commissioner of Patents and Trademarks*